US011846395B2

(12) United States Patent
Wang

(10) Patent No.: US 11,846,395 B2
(45) Date of Patent: Dec. 19, 2023

(54) WRAP-AROUND FLARED LAMP

(71) Applicant: DONGGUAN HUIHUAN LIGHTING CO., LTD, Dongguan (CN)

(72) Inventor: Song Wang, Chengdu (CN)

(73) Assignee: DONGGUAN HUIHUAN LIGHTING CO., LTD, Dongguan (CN)

( * ) Notice: Subject to any disclaimer, the term of this patent is extended or adjusted under 35 U.S.C. 154(b) by 0 days.

(21) Appl. No.: 17/866,585

(22) Filed: Jul. 18, 2022

(65) Prior Publication Data

US 2022/0349532 A1 Nov. 3, 2022

(30) Foreign Application Priority Data

Jun. 30, 2022 (CN) ..... 202221663896.8

(51) Int. Cl.

| | |
|---|---|
| ***F21K 9/235*** | (2016.01) |
| ***F21V 23/06*** | (2006.01) |
| ***F21K 9/232*** | (2016.01) |
| *F21Y 115/10* | (2016.01) |

(52) U.S. Cl.

CPC ..... *F21K 9/235* (2016.08); *F21K 9/232* (2016.08); *F21V 23/06* (2013.01); *F21Y 2115/10* (2016.08)

(58) Field of Classification Search

CPC ..... F21K 9/235; F21K 9/232; F21V 23/06

See application file for complete search history.

(56) References Cited

U.S. PATENT DOCUMENTS

| | | | | |
|---|---|---|---|---|
| 2012/0187817 | A1* | 7/2012 | Chuang | F21K 9/232 313/46 |
| 2012/0187818 | A1* | 7/2012 | Chuang | F21V 29/83 313/46 |
| 2012/0188775 | A1* | 7/2012 | Chuang | F21K 9/232 362/373 |
| 2012/0217862 | A1* | 8/2012 | Matsuda | F21K 9/232 313/46 |
| 2012/0224371 | A1* | 9/2012 | Hsueh | F21K 9/232 362/249.02 |

(Continued)

FOREIGN PATENT DOCUMENTS

| | | | | |
|---|---|---|---|---|
| CN | 203784682 U | * | 8/2014 | F21K 9/232 |
| CN | 210950837 U | * | 7/2020 | |

OTHER PUBLICATIONS

English translation of CN-210950837-U Wang, published Jul. 2020 (Year: 2020).*

(Continued)

*Primary Examiner* — Evan P Dzierzynski
(74) *Attorney, Agent, or Firm* — Zhigang Ma

(57) ABSTRACT

The present disclosure relates to the technical field of lamps, and discloses a wrap-around flared lamp. The wrap-around flared lamp includes a lamp base and a shell connected to the lamp base. The lamp base is provided with an extending part which is wrapped around and fixedly connected to an opening part of the shell; the wrap-around flared clamp further includes a stem structure which is electrically connected to the lamp base and extends into the shell; the stem structure includes a first metal wire, a first luminophor and a second metal wire which are electrically connected in sequence; and the first metal wire and the second metal wire are electrically connected to the lamp base respectively.

4 Claims, 7 Drawing Sheets

(56) References Cited

U.S. PATENT DOCUMENTS

| | | | | |
|---|---|---|---|---|
| 2015/0267872 | A1* | 9/2015 | Huang | H05K 1/00 362/249.06 |
| 2016/0258580 | A1* | 9/2016 | Sun | F21K 9/232 |
| 2017/0227169 | A1* | 8/2017 | Jiang | F21V 3/02 |
| 2017/0292692 | A1* | 10/2017 | Chen | F21V 23/006 |
| 2018/0347802 | A1* | 12/2018 | Fu | F21V 29/73 |
| 2019/0195435 | A1* | 6/2019 | Ye | F21K 9/232 |
| 2020/0208787 | A1 | 7/2020 | Yang | |
| 2020/0370711 | A1* | 11/2020 | Fu | F21V 29/70 |
| 2021/0025582 | A1 | 1/2021 | Xie | |
| 2021/0116123 | A1 | 4/2021 | Feng et al. | |

OTHER PUBLICATIONS

English translation of CN-203784682-U Fujita, published Aug. 2014 (Year: 2014).*

* cited by examiner

WRAP-AROUND FLARED LAMP

TECHNICAL FIELD

The present disclosure relates to the technical field of lamps, in particular to a wrap-around flared lamp.

BACKGROUND ART

With the popularity of electricity, lamps have been used in thousands of households. People are no longer limited to using lamps for ordinary lighting, but also more inclined to use lamps to create different atmospheres. For example, people use lamps in family gatherings, parties and other outdoor entertainment venues to heighten the atmosphere of parties, spice up the parties, enhance the artistic effect, etc.

For better decoration and lighting effects, S14 large-size lamps (the diameter of each of which is about 45 mm) are usually used for decoration in meeting places. There is a lamp formed by connecting an E12 lamp base (the diameter of which is about 12 mm) to an S14 shell. According to this kind of lamp, the manufacturing cost of the lamp is reduced by reducing, the size of the lamp. Although the production cost of this kind of lamp can be reduced, an opening part of the shell needs to be reduced to a size of E12 that can adapt to a threaded part of the lamp base, so that the size of the opening part of the shell is greatly different from the overall size of the shell. As a result, when blow molding equipment blow-molds the S14 shell, the overall thickness of the S14 shell is not uniform. A part, closer to the opening part, of the shell is thicker, and a part, away from the opening part, of the shell is too thin. Furthermore, since the opening part of the shell has a small size, it is extremely difficult to control the wall thickness of the shell, and the yield is low. In order to solve the above-mentioned problems, the inventors have made new inventions.

SUMMARY

The present disclosure aims to overcome the shortcomings in the prior art and provide a wrap-around flared lamp which has the characteristics of easy forming and high yield.

In order to achieve the above objective, the present disclosure provides a wrap-around flared clamp. The wrap-around flared clamp includes a lamp base and a shell connected to the lamp base. The lamp base is provided with an extending part which is wrapped around and fixedly connected to an opening part of the shell; the wrap-around flared clamp further includes a stem structure which is electrically connected to the lamp lame and extends into the shell; the stem structure includes a first metal wire, a first luminophor and a second metal wire which are electrically connected in sequence; and the first metal wire and the second metal wire are electrically connected to the lamp base respectively.

Preferably, the extending part and the lamp base are both made of conductive metal materials and are integrally formed; and an insulation layer is arranged outside the extending part.

Preferably, an inclined part is further arranged at a joint of the extending part and the lamp base.

Preferably, the extending part is provided with an outer edge at a rim of an outer end.

Further, connection between, the extending part and the opening part of the shell is buckling, adhesion or threaded connection.

Preferably, an annular clamping block is arranged on an outer side of the opening part of the shell; and a clamping slot matched with the annular clamping block is arranged inside the extending part.

Preferably, the opening part of the shell is provided with an adhesive part; and an outer side of the adhesive part is adhered and fixed to an inner side of the extending part through an adhesive.

Preferably, the stem structure comprises a plastic sealing seat with an elastic waterproofing effect; and the plastic sealing seat is in hermetically tight fit with the inner side of the opening part of the shell.

Further, the plastic sealing seat comprises a cylindrical part used for waterproof sealing; an upper part of the cylindrical part is connected with a supporting part; and a lower part of the cylindrical part is provided with a flange.

Preferably, the first luminophor is a Light-Emitting Diode (LED) lamp strip which is integrated and packaged with a resistor.

Beneficial effects: Compared with the prior art, the present disclosure is a wrap-around flared lamp. The wrap-around flared lamp includes a lamp base and a shell connected to the lamp base. The lamp base is provided with an extending part which is wrapped around and fixedly connected to an opening part of the shell; the wrap-around flared clamp further includes a stem structure which is electrically connected to the lamp base and extends into the shell; the stem structure includes a first metal wire, a first luminophor and a second metal wire which are electrically connected in sequence; and the first metal wire and the second metal wire are electrically connected to the lamp base respectively. The wrap-around flared lamp has the following advantages: 1. The lamp base is provided with an annular extending part to form a wrapping flaring; and the extending part is wrapped around the opening part of the shell to expand the opening part of the shell, so that the thickness of the shell is easy to control and balance during blow-molding of the shell, and the yield is high. 2. The extending part is also provided with an insulation layer; when it is connected to a lamp holder, the extending part has a sealing and waterproofing effect and the wrap-around flared lamp is safer. 3. The wrap-around flared lamp is simple in structure and convenient to use.

REFERENCE NUMERALS

Figure 1:
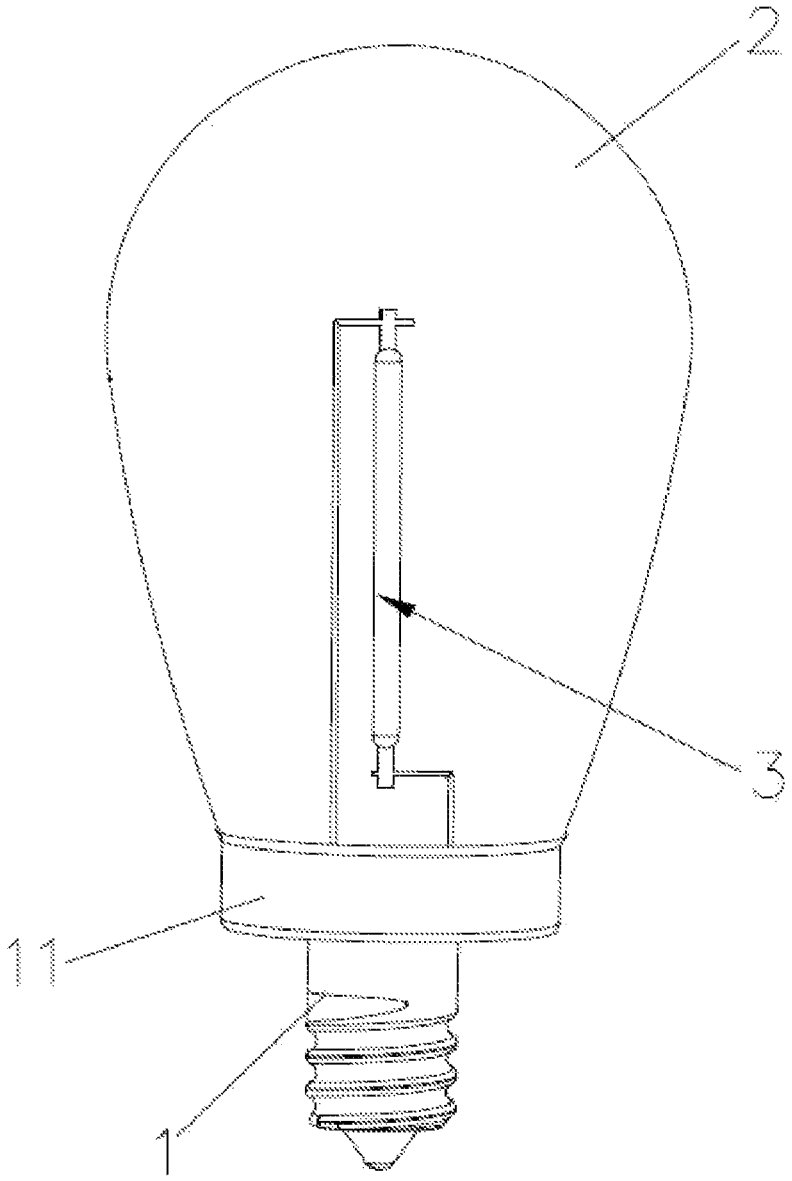
FIG. 1 is a schematic three-dimensional diagram of the present disclosure.

1: lamp base; 11: extending part; 12: insulation layer; 13: inclined part; 14: outer edge; 15: clamping slot; 2: shell; 21: annular clamping block; 22 adhesive part; 3: stein structure; 31: first metal wire; 32: first lamp strip; 33: second metal wire; 34: plastic sealing seat; 341: cylindrical part; 342 supporting part; 343: flange; 344: sealing hole; 345: second luminophor; 346: supporting column; 347: third metal wire; and 4: resistor.

DETAILED DESCRIPTION OF THE EMBODIMENTS

The present disclosure is described in detail below in combination of FIGS. 1-7.

The present disclosure discloses a wrap-around flared clamp, including a lamp base 1 and a shell 2 connected to the lamp base 1, wherein the lamp base 1 is provided with an extending part 11 which is wrapped around and fixedly connected to an opening part of the shell 2; the wrap-around flared clamp further includes a stem structure 3 which is electrically connected to the lamp base 1 and extends into the shell 2; the stem structure 3 includes a first metal wire 31, a first luminophor 32 and a second metal wire 33 which are electrically connected in sequence; and the first metal wire 31 and the second metal wire 33 are electrically connected to the lamp base 1 respectively. The lamp base 1 of the present disclosure can adopt the integrally formed extending part 11 above a threaded part. The extending part 11 is wrapped around the opening part of the shell 2; the opening part of the shell 2 is abutted against the inside of the extending part 11; the opening part of the shell 2 no longer needs to extend into the threaded part of the lamp base 1, so that the opening part of the shell 2 does not need to be matched with the threaded part, and the threaded part only needs to be connected to the lamp base. The opening part of the shell 2 can be correspondingly made in a large size. An E12 lamp base can be connected to an E26 shell. When a blow molding machine is used to blow-mold the shell 2, the overall thickness of the shell 2 is more uniform, and a wall thickness is easier to control. The yield of the lamp is increased. The improved lamp has a simple structure; the production cost of a large-size lamp can be reduced; and the problems that the shell 2 has a non-uniform thickness and low yield and is fragile can be well solved.

In order to further save the manufacturing cost, the extending part 11 and the lamp base 1 are both made of conductive metal materials and are integrally formed; and an insulation layer 12 is coated or sleeved outside the extending part 11. The integrated forming process simplifies the lamp manufacturing flow and shortens the manufacturing time. Since the extending part 11 is provided with the insulation layer 12, when the lamp is externally connected to a lamp holder, the insulation layer 12 is located between the lamp base 1 and the lamp holder to achieve a sealing effect. It is difficult for water to enter the lamp holder. In addition, the extending part 11 lengthens the lamp base 1 and is made of a metal material, so that when the lamp is externally connected to the lamp holder, the extending part 11 may be possibly partially exposed from the lamp holder. Due to the conductive effect of the metal material, the extending part 11 is live. In order to improve the safety, the extending part 11 is sleeved or coated with one insulation layer 12, which can improve the safety of the lamp.

Figure 2:
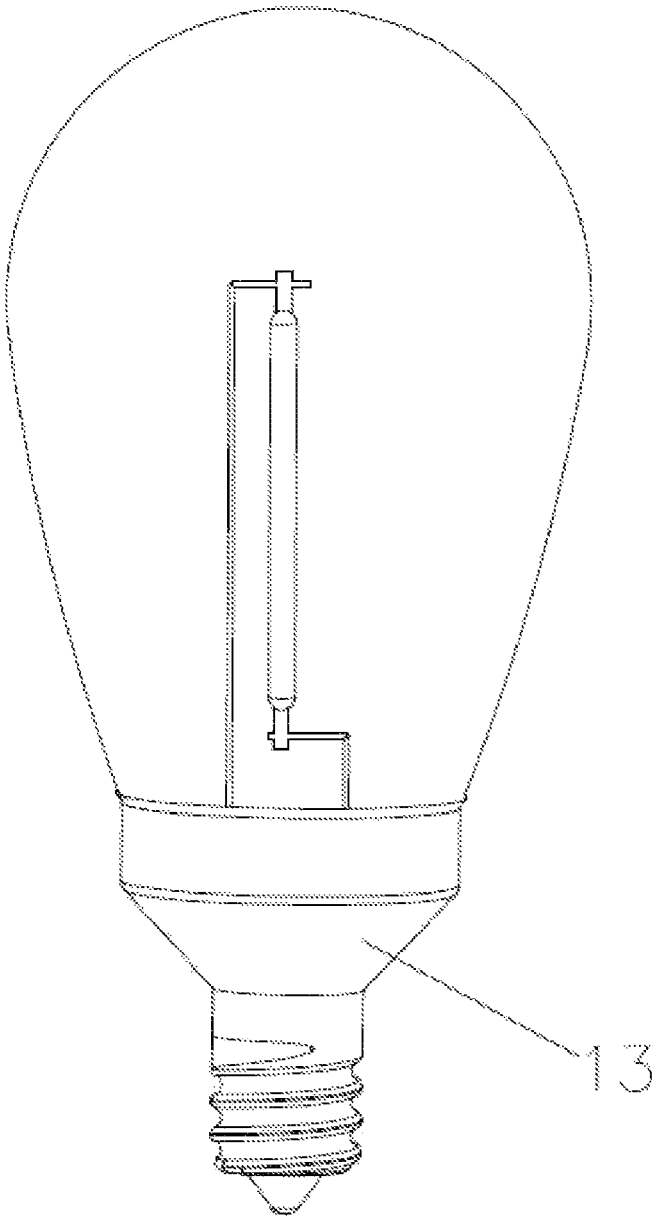
FIG. 2 is a schematic structural diagram of an inclined part of the present disclosure.
Figure 3:
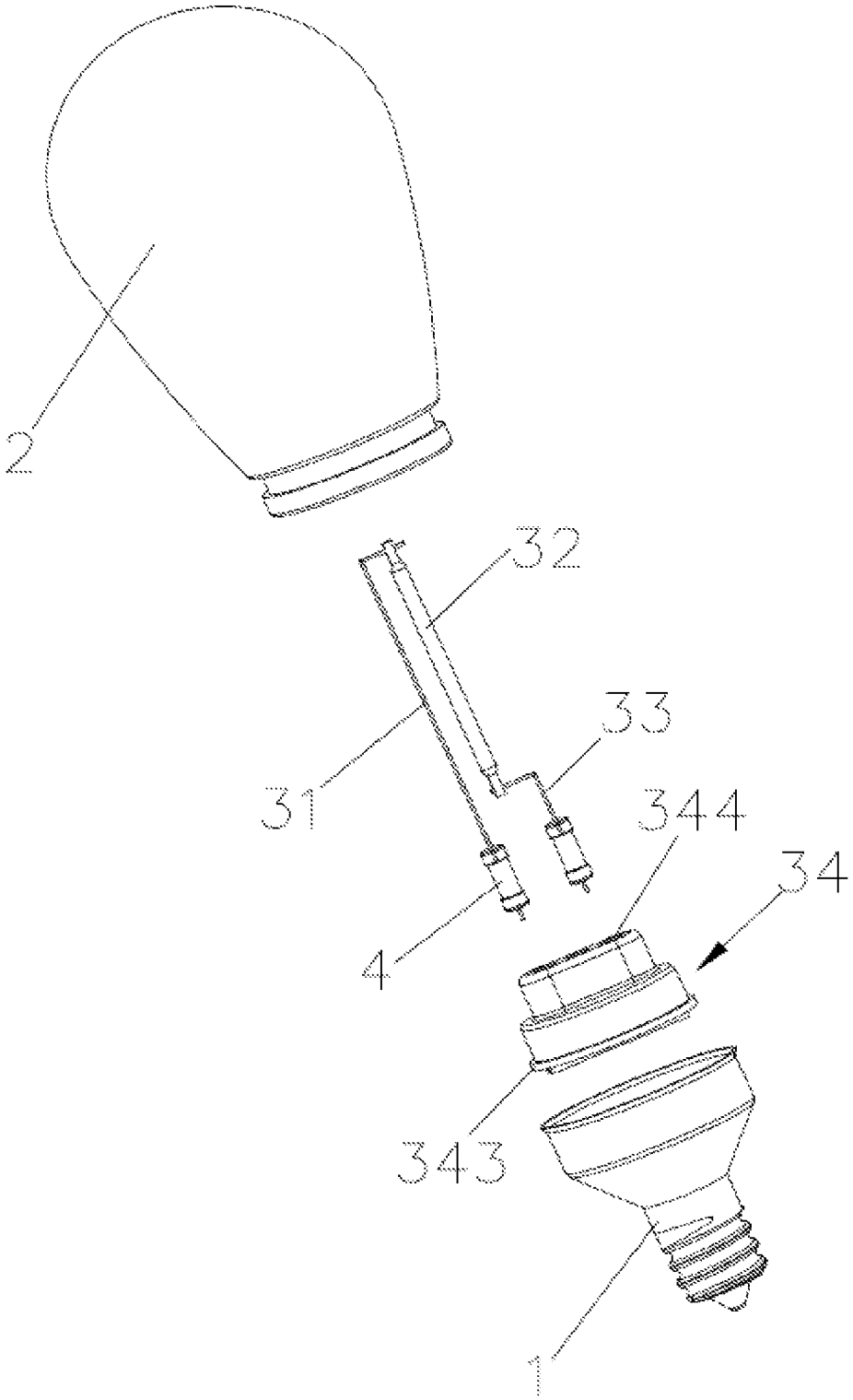
FIG. 3 is a schematic exploded structural diagram of the present disclosure.

As shown in FIG. 2, in order to further improve the implementation solution, an inclined part 13 is further arranged at a joint of the extending part 11 and the lamp base 1. In the embodiment where the extending part 11 includes the inclined part 13, the extending part can be further away from the lamp base 1, thus achieving an objective of further enlarging the opening part of the shell 2. A better technical effect is achieved; the forming yield is higher; and the wall thickness of the shell is easier to control. In another aspect, the lamp base 1 with the inclined part 13 makes the lamp more attractive. Specifically, during production and manufacturing of the lamp, the inclined part 13 increases a longitudinal length of the extending part 11; a joint of the opening part of the shell 2 and the extending part 11 can be correspondingly shortened; the extending part 11 can also be correspondingly shortened; and the manufacturing cost is reduced. In addition, due to the inclined part 13, during manufacturing of the extending part 11, it is easier to increase a transverse width dimension of the extending part 11, and it is convenient to connect the lamp base 1 to a larger-size lamp.

As a preference, the extending part 11 is provided with an outer edge 14 at a rim of an outer end. When the lamp base 1 is connected to the shell 2, the outer edge 14 is abutted against the shell 2, which has a certain sealing and waterproofing effect.

In this technical solution, there are various connection manners between the extending part 11 and the opening part of the shell 2, such as clamping connection, adhesion or threaded connection. For the threaded connection, threads are formed at, both an inner wall of the extending part 11 and an outer side of the opening part of the shell 2, and the extending part and the shell are in threaded connection to assemble the shell 2 to the lamp base 1.

Figure 4:
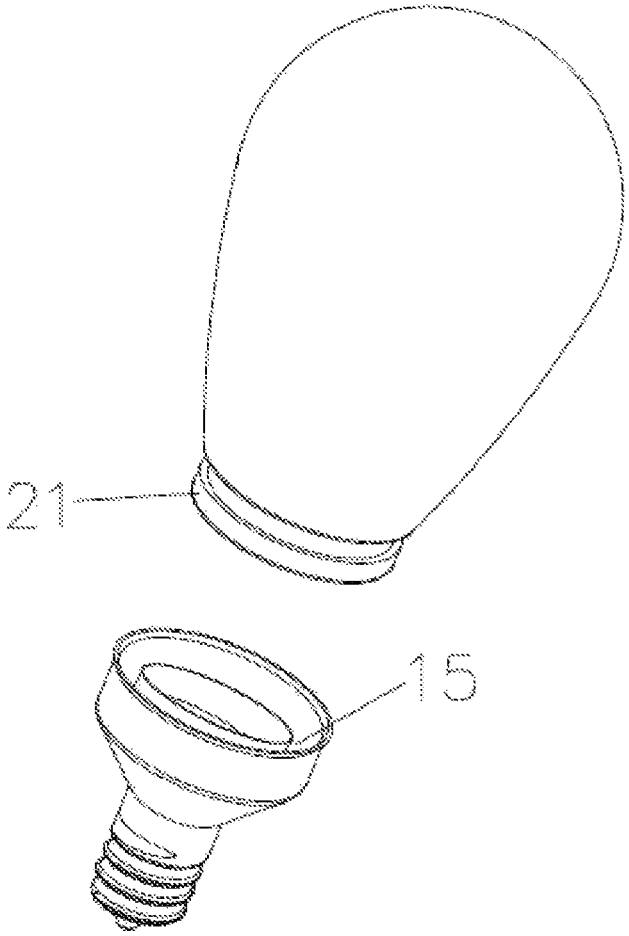
FIG. 4 is a schematic structural diagram of clamping of a shell and an extending part of the present disclosure.

When the shell 2 and the extending part 11 are connected in a clamping connection manner, as shown in FIG. 4, according to one implementation, an annular clamping block 21 is arranged on the outer side of the opening part of the shell 2; and a clamping slot 15 matched with the annular clamping block 21 is arranged inside the extending part 11. During assembling, the annular clamping block 21 of the shell 2 is aligned with the clamping slot 15 for clamping, so that the structure is simple, and the assembling is fast and convenient.

Figure 5:
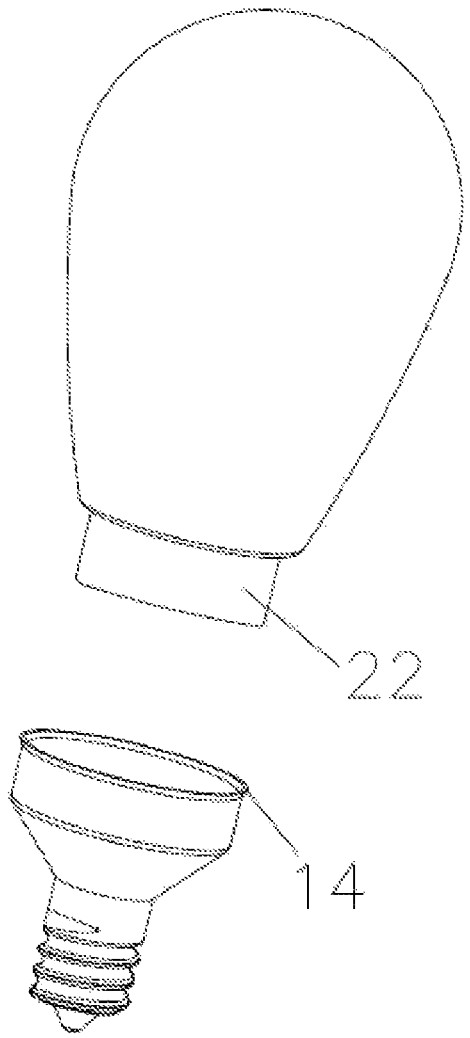
FIG. 5 is a schematic structural diagram of adhesion of a shell and an extending part of the present disclosure.

When the shell 2 and the extending part 11 are connected in a clamping connection, manner, as shown in FIG. 5, as a preference, a tubular adhesive part 22 is arranged at the opening part of the shell 2, and an outer side of the adhesive part 22 is adhered and fixed to an inner side of the extending part 11 through an adhesive. During assembling, a circle of adhesive is applied to the inner wall of the extending part 11, and the adhesive part 11 of the shell 2 is slowly pushed into the extending part 11 for adhesion and fixing. The adhesive may be an ordinary adhesive, such as instant adhesive, or may be an adhesive with a waterproofing effect to further prevent water from entering the shell 2.

As another embodiment, the stem structure 3 includes a plastic sealing seat 34. The plastic sealing seat 34 fixes and supports the stem structure 3. On the basis of this, the plastic sealing seat 34 is in hermetical tight fit with the inner side of the opening part of the shell 2 to further achieve a sealing and waterproofing effect. The plastic sealing seat 34 made of a plastic material has certain elasticity, so that the plastic sealing seat 34 is in tighter fit with the inner side of the opening part of the shell 2, so as to achieve the sealing and waterproofing effect.

As one embodiment, the plastic sealing seat 34 includes a cylindrical part 341 used for waterproof sealing; an upper part of the cylindrical part 341 is connected with a supporting part 342; and a lower part of the cylindrical part 341 is provided with a flange 343. The cylindrical part 341 and an opening part of the plastic sealing seat 34 are sealed and waterproofed, and the flange 343 is used for covering the opening part of the plastic sealing seat 34 to improve the airtightness. The supporting part 342 has functions of supporting and positioning the first metal wire 31 and the second metal wire 33.

In this technical solution, when a resistor needs to be mounted independently, the plastic sealing seat 34 is provided with at least two sealing holes 344. The first metal wire 31 and the second metal wire 33 pass through the plastic sealing seat 34 through the sealing holes 344 and are connected to a wire of the lamp base 1 to form a complete circuit. At the same time, a bottom of each sealing hole 344 is sealed, so that it is hard for water to enter the shell 2. In another aspect, the sealing holes 344 are also used for mounting a resistor 4. The resistor 4 is generally mounted on the first metal wire 31 or the second metal wire 33 to protect the first luminophor 32 and prolong the life of the lamp. The resistor 4 is mounted in the sealing holes 344 to position the resistor 4.

As another embodiment, when the resistor 4 does not need to be mounted independently, the first luminophor 32 is an LED lamp strip which is integrated and packaged with the resistor 4. In this solution, the resistor 4 is directly integrated and packaged in the luminophor. The resistor 4 can also achieve effects of protecting the LED lamp strip and the like. At the same time, the resistor 4 is directly fixed, so that no other parts need to be disposed on the lamp to fix the resistor 4. Therefore, the structure is simpler, and the production procedures are optimized.

Figure 6:
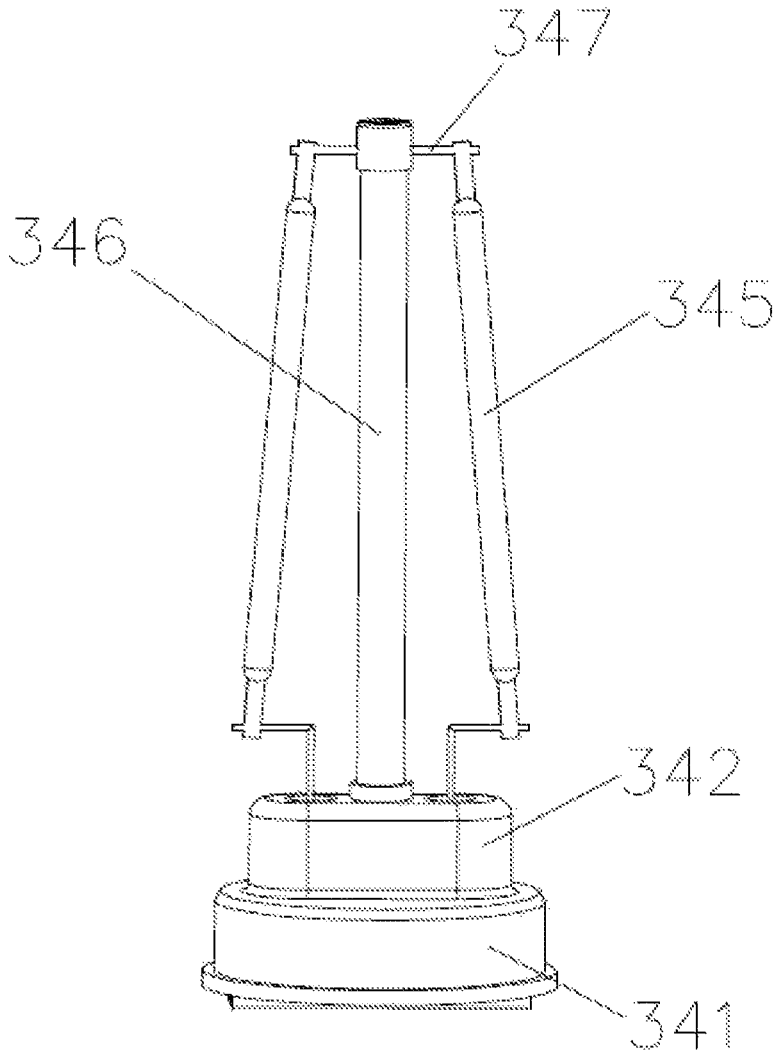
FIG. 6 is a schematic structural diagram of a double-luminophor stem structure of the present disclosure.
Figure 7:
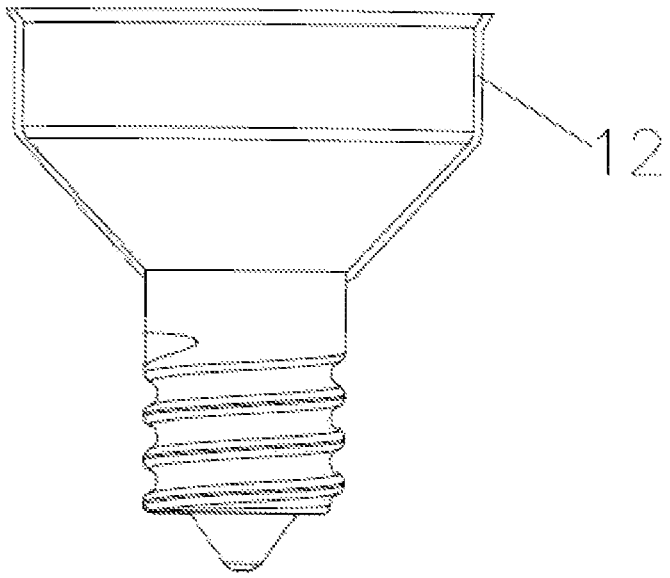
FIG. 7 is a schematic structural diagram of an insulation layer of the present disclosure.

As shown in FIG. 6, the stem structure 3 of the present disclosure can also be an embodiment with two lamp strips. The stem structure 3 also includes a second luminophor 345 and a supporting column 346. A bottom of the supporting column 346 is connected to the plastic sealing seat 34, and a top is provided with a third metal wire 347. Two ends of the first luminophor 32 are respectively connected to the first metal wire 31 and the third metal wire 347. Two ends of the second luminophor 345 are respectively connected to the second metal wire 33 and the third metal wire 347. Since the stem is provided with two luminophors, the lamp has a better lighting effect. Me symmetric luminophors are more beautiful. Of course, luminophors can be continuously added to the stem structure 3 according to an actual need.

The above contents are only preferred embodiments of the present disclosure. Those of ordinary skill in the art can make changes to the specific implementations and application scopes according to the idea of the present disclosure, and the contents of this specification shall not be understood as restrictions to the present disclosure.

What is claimed is:

1. A wrap-around flared lamp, comprising a lamp base (1) and a shell (2) connected to the lamp base (1), wherein the lamp base (1) is provided with an extending part (11) which is wrapped around and fixedly connected to an opening part of the shell (2);

the wrap-around flared lamp further comprises a stem structure (3) which is electrically connected to the lamp base (1) and extends into the shell (2); the stem structure (3) comprises a first metal wire (31), a first luminophor (32) and a second metal wire (33) which are electrically connected in sequence; and the first metal wire (31) and the second metal wire (33) are electrically connected to the lamp base (1) respectively;

wherein the opening part of the shell (2) has a diameter greater than a diameter of the lamp base; the extending part (11) has a diameter greater than the diameter of the lamp base (1);

the shell (2) comprises a bulbous body and a neck, the neck is narrower in diameter compared to an end of the bulbous body connected with the neck, so as to form a step transition between neck and the bulbous body; wherein the extending part (11) is provided with an outer edge (14) extending out from a rim of an outer end away from the lamp base; the outer edge (14) is abutted against the step transition for sealing the shell and the extending part;

wherein the neck of the shell (2) is an adhesive part (22) for inserting the extending part; and an outer side of the adhesive part (22) is adhered and fixed to an inner side of the extending part (11) through an adhesive;

wherein an inclined part (13) is further arranged at a joint of the extending part (11) and the lamp base (1); a first connection portion between the extending part (11) and the inclined part (13) has a diameter greater than a diameter of a second connection portion between the inclined part (13) and the lamp base (1), so that the extending part (11) is capable of receiving the opening part of the shell (2) which has the diameter greater than the diameter of the lamp base (1); wherein the extending part, the inclined part, and the lamp base are made of conductive metal material and are integrally formed; and an insulation layer (12) is arranged outside the extending part (11).

2. The wrap-around flared lamp according to claim 1, wherein the stem structure (3) comprises a plastic sealing seat (34) with an elastic waterproofing effect; and the plastic sealing seat (34) is in hermetically tight fit with the inner side of the opening part of the shell (2).

3. The wrap-around flared lamp according to claim 2, wherein the plastic sealing seat (34) comprises a cylindrical part (341) used for waterproof sealing; an upper part of the cylindrical part (341) is connected with a supporting part (342); and a lower part of the cylindrical part (341) is provided with a flange (343).

4. The wrap-around flared lamp according to claim 1, wherein the first luminophor (32) is a Light-Emitting Diode (LED) lamp strip which is integrated and packaged with a resistor (4).

* * * * *